US005398175A

United States Patent [19]

Pea

[11] Patent Number: 5,398,175

[45] Date of Patent: Mar. 14, 1995

[54] ILLUMINATED DOOR KNOB LOCK

[76] Inventor: Todd D. Pea, 7375 W. Beryllium La., Tucson, Ariz. 85743

[21] Appl. No.: 196,563

[22] Filed: Feb. 15, 1994

[51] Int. Cl.[6] ..... E05B 17/10

[52] U.S. Cl. ..... 362/100; 315/84

[58] Field of Search ..... 315/84, 76; 362/100, 362/253, 94

[56] References Cited

U.S. PATENT DOCUMENTS

| | | | |
|---|---|---|---|
| 1,929,741 | 10/1933 | Hall et al. | 362/100 |
| 1,985,483 | 12/1934 | Clarke | 362/100 |
| 2,029,002 | 1/1936 | Smiley | 362/100 |
| 3,280,321 | 10/1966 | Overesch | 362/100 |
| 3,719,821 | 3/1973 | Foreman | 362/100 |
| 3,955,075 | 5/1976 | Susedik | 362/100 |
| 4,475,067 | 10/1984 | Rowe | 315/360 |
| 4,777,570 | 10/1988 | Littles | 362/100 |
| 5,057,975 | 10/1991 | Evigan | 362/100 |

*Primary Examiner*—Stephen F. Husar
*Assistant Examiner*—Alan B. Cariaso
*Attorney, Agent, or Firm*—Rhodes and Ascolillo; David L. Baker

[57] ABSTRACT

An illuminated locking doorknob apparatus for a door has a door locking set. The door locking set has a knob and lock retaining mechanism that passes through the door. A lock core is removingly and rotatingly secured within the knob and lock retaining mechanism. At least one knob is releasingly secured to the knob and lock retaining mechanism. A keyhole, in the lock core, is accessible through a first port in a wall of the knob. An illumination circuit is within the door locking set. The illumination circuit has a removable DC power source and a removable DC light source in the circuit. The light source is adjacent the keyhole and the light source protrudes through a second port in the wall of the knob to illuminate the keyhole so that a key may be more easily inserted therein. There is a switch in the illumination circuit. The switch has a stationary contact and a sliding contact rod, connected to and actuated by the knob, springingly biased away from the stationary contact. There is a light diffusing directional lens, releasably connected to the wall of the knob, over the light source to protect the light source and to assist in placing light upon the keyhole.

3 Claims, 3 Drawing Sheets

ILLUMINATED DOOR KNOB LOCK

BACKGROUND OF THE INVENTION

1. Field of the Invention

This invention relates-to an illuminated keyhole slot with which a user can insert a key into the keyhole with more accuracy.

2. Description of the Related Art

The related art patents reveal various solutions to the difficulty encountered when one tries to unlock a door in the dark. The solutions revealed are somewhat complicated and are difficult to install and repair.

U.S. Pat. No. 3,955,075 to J. Susedik on May 04, 1976 for a Doorknob Illuminating Device describes a lucite rod illuminated by a light source. The lucite rod, in turn illuminates a lucite rose ring which illuminates the area around the keyhole.

U.S. Pat. No. 4,475,067 to D. L. Rowe on Oct. 02, 1984 for a Door Lock Illuminating Device shows an illuminating device that is suspended above a lock. The device may be set to vary the amount of time the lock is illuminated.

U.S. Pat. No. 4,777,570 to G. Littles on Oct. 11, 1988 for an Illuminated Doorknob Lock describes a translucent knob having two lights positioned about a central bore lock mechanism. The lights illuminate the knob to assist in locating the keyhole.

The present invention not only solves the problem of illuminating the keyhole to facilitate the insertion of the key in to the keyhole, it does so in an uncomplicated unique manner which facilitates easy installation and repair.

SUMMARY OF THE INVENTION

Even with porch lights, most people still have difficulty placing a key into a keyhole in the dark. Several solutions to this problem have been tried in the past. One such solution is to use a key chain having a key chain light thereon. However, this solution requires that everyone needing to unlock the door have a key chain light. The present invention does not force such redundancy on the people needing to gain access through the door. The present invention is an illuminating device placed conveniently within the knob and the lock retaining mechanism in the door. It has, preferably, a green light bulb or green lens cover over a bulb. The green color enhances the illumination of a brass door knob. Other colors can be used per the user's preference. Replacement of the circuit is enhanced by providing a sufficient amount of wire to allow the user to pull the various components out for repair or replacement. Existing knobs and locking mechanisms may be modified to accommodate the present invention or new knobs and locking mechanisms may be manufactured with the invention therein ready to install in a door.

The light is activated by pushing the knob in toward the door. There is a sliding contact (usually rodlike) connected to the knob. As the knob and the sliding contact are pushed inward, the sliding contact touches the stationary contact and the circuit is completed. Once the circuit is completed, the light comes on powered by the DC battery. The door-knob is under spring pressure when it is pushed in. This biases the knob and the sliding contact away from the stationary contact. This automatically lowers battery discharge by reducing the chance that the user might inadvertently leave the light on (such as might happen with a regular on/off switch). Once the spring forces the sliding contact to disengage the stationary contact, the circuit is broken, the light is extinguished and battery drain is reduced. A wire connects the battery to the sliding contact and another wire connects the opposite pole of the battery to the stationary contact.

In a first embodiment of the present invention, an illuminated locking doorknob apparatus for a door is shown that has a door locking set. The door locking set has a knob and lock retaining mechanism that passes through the door. A lock core is removingly and rotatingly secured within the knob and lock retaining mechanism. At least one knob is releasingly secured to the knob and lock retaining mechanism. A keyhole, in the lock core, is accessible through a first port in a wall of the knob. There is a illumination circuit within the door locking set. The illumination circuit has a power source in the circuit. There is a light source, adjacent the keyhole and protruding through (it may also not protrude through the wall and may rest even with or just below the wall) a second port in the wall of the knob, in the circuit. A switch, in the circuit, has a stationary contact attached to a insulation member and a sliding contact. The sliding contact is connected to and is actuated by the knob and is springingly biased away from the stationary contact. There is a lens, connected to the wall of the knob, over the light source.

In a second embodiment, an illuminated locking doorknob apparatus for a door is shown that has a door locking set. The door locking set has a knob and lock retaining mechanism, passing through the door. There is a lock core removingly and rotatingly secured within the knob and lock retaining mechanism. At least one knob is releasingly secured to the knob and lock retaining mechanism. There is a keyhole, in the lock core, accessible through a first port in a wall of the knob. An illumination circuit is within the door locking set. The illumination circuit has a removable power source in the circuit. There is a removable light source, adjacent the keyhole and protruding through (it may also not protrude through the wall and may rest even with or just below the wall) a second port in the wall of the knob, in the circuit. The switch, in the circuit, has a stationary contact attached to a insulation member. There is a sliding contact rod, connected to and is actuated by the knob. The sliding contact rod is springingly biased away from the stationary contact. A light diffusing directional lens is releasably connected to the wall of the knob and is over and covers the light source.

It is an object of this invention to provide a device to illuminate a keyhole on a door knob to allow easier ingress of the key into the lock at night.

DESCRIPTION OF THE PREFERRED EMBODIMENTS

Figure 1:
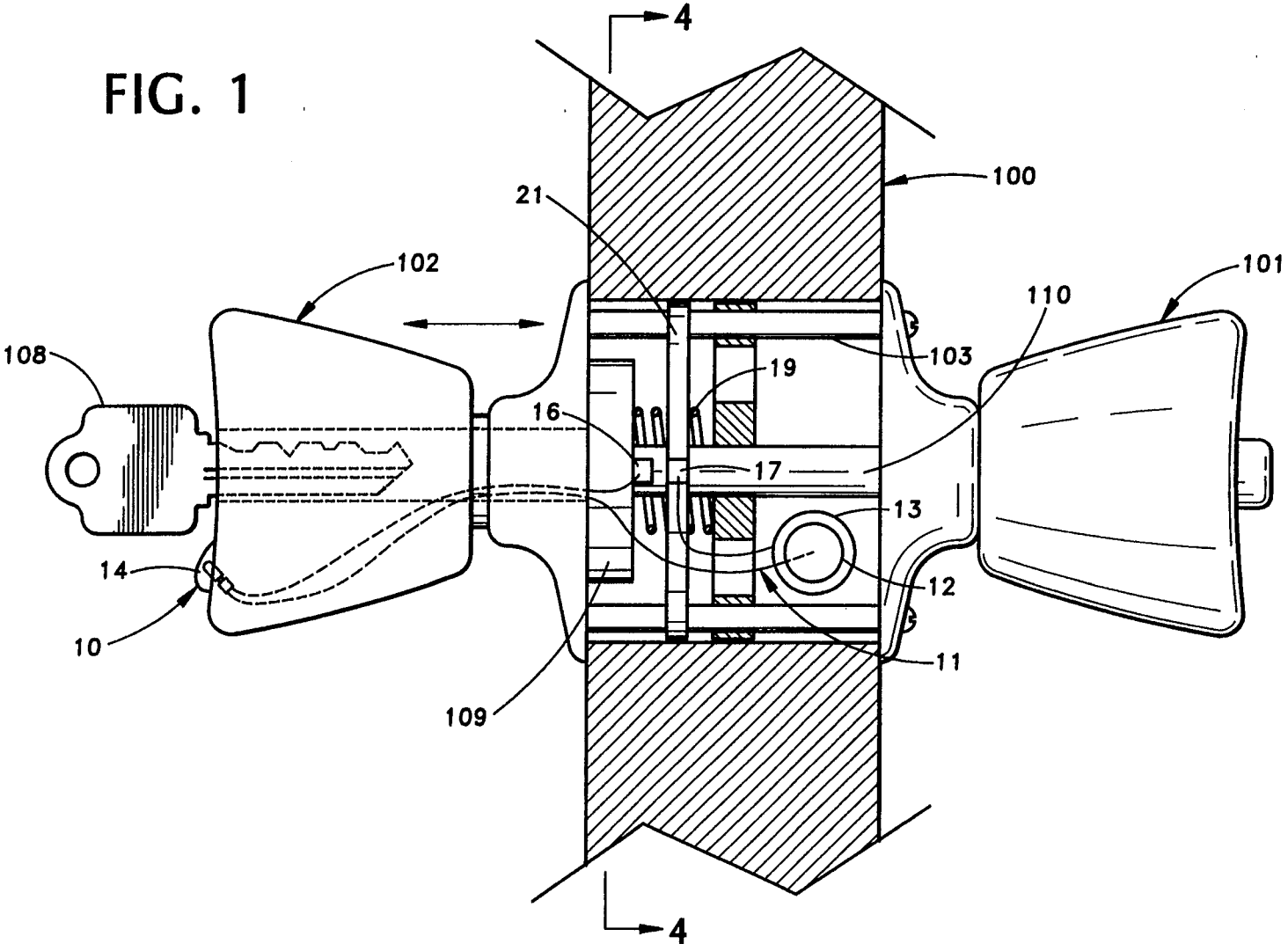
FIG. 1 is a partial cross-section of a door having an illuminated locking doorknob apparatus shown in partial cross-section. The knob and sliding contact rod is shown out of contact with the stationary contact and therefore the light is not illuminating the keyhole.
Figure 2:
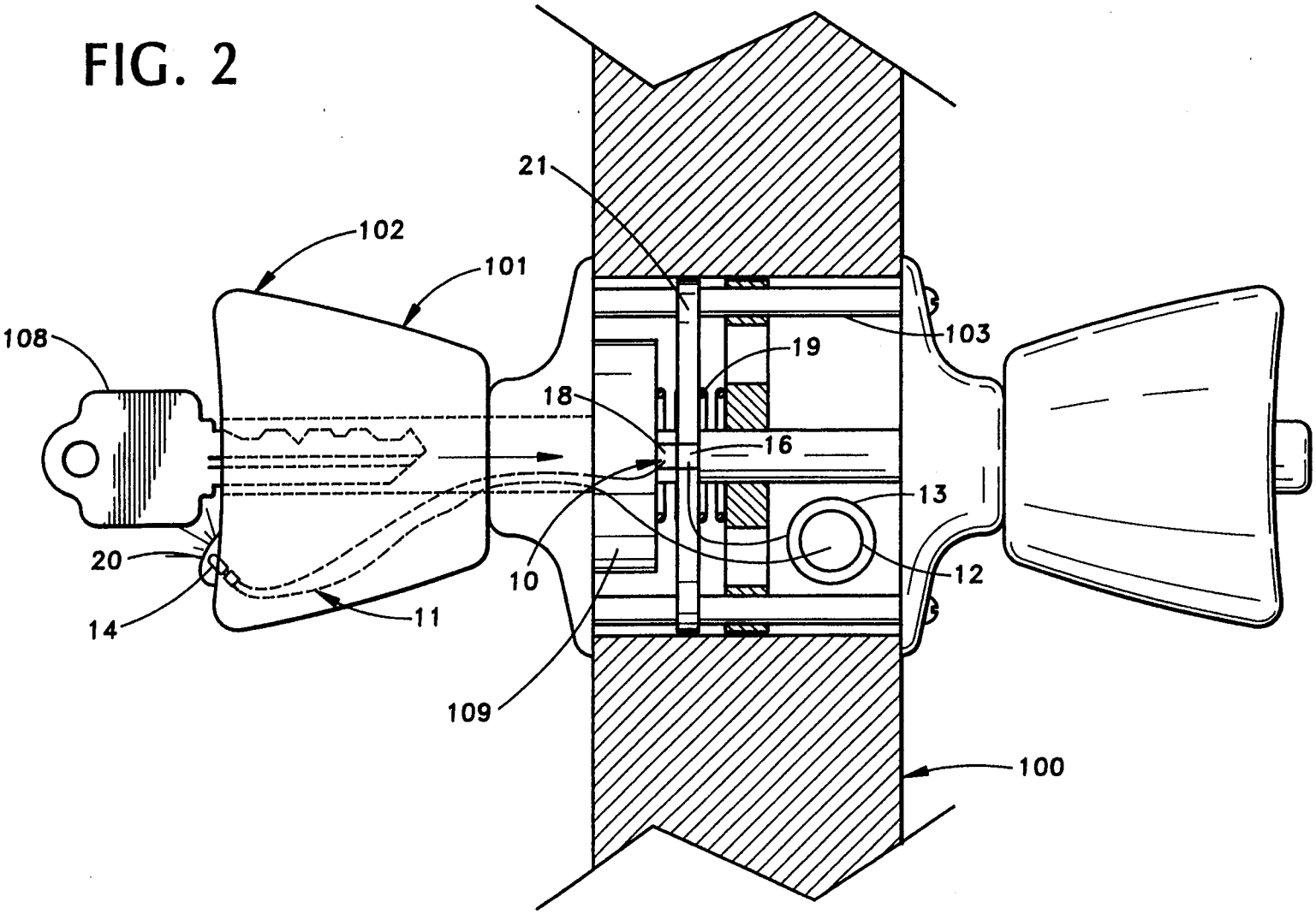
FIG. 2 is a partial cross-section of a door having an illuminated locking doorknob apparatus shown in partial cross-section. The knob and sliding contact rod is shown slid forward and in contact with the stationary contact and therefore the light is illuminating the keyhole.
Figure 3:
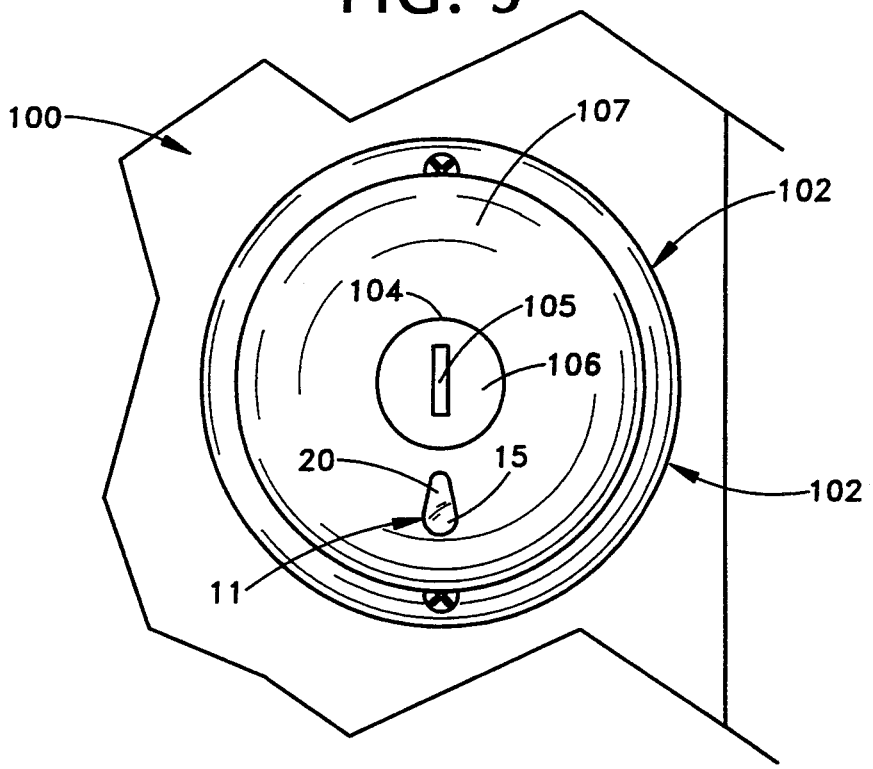
FIG. 3 is a front elevational view of FIG. 1 with a cut-away view of the door.
Figure 4:
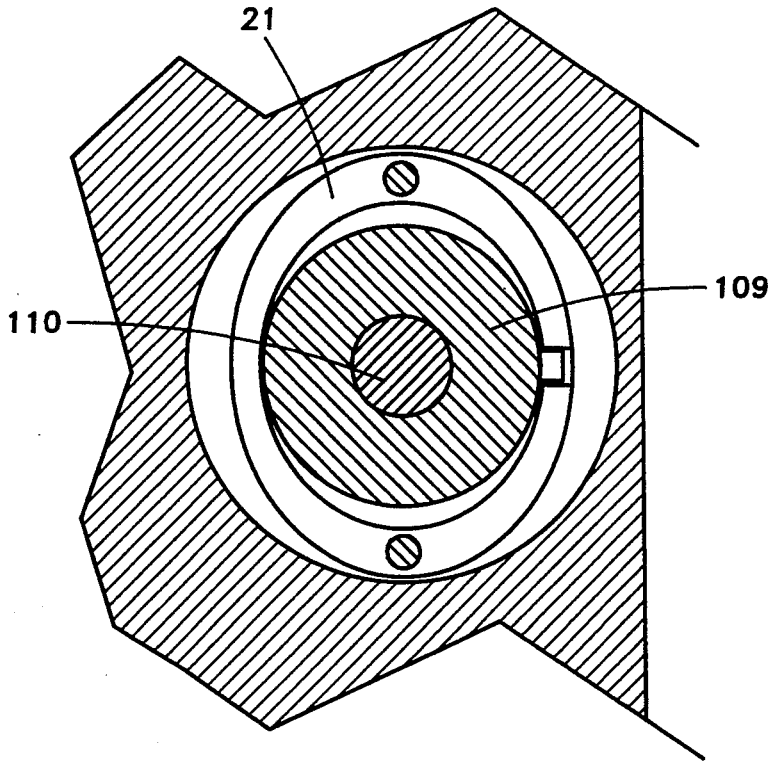
FIG. 4 is a cross-sectional view taken along lines 4—4 of FIG. 1.

Referring to FIGS. 1 through 3, an illuminated locking doorknob apparatus 10 for a door 100 is shown and described that has a door locking set 101. The door locking set 101 has a knob 102 and lock retaining mechanism 103 that passes through the door 100. There is a lock core 104 removingly and rotatingly secured within the knob 102 and lock retaining mechanism 103. At least one knob 102 is releasingly secured to the knob and lock retaining mechanism 103. A keyhole 105, in the lock core 104, is accessible through a first port 106 in a wall 107 of the knob. There is also a spring backing plate 109. Actuation spindle 110 in shown in cross-section in FIG. 4. There is a illumination circuit 11 within the door locking set. The illumination circuit 11 has a removable DC power source 12 (at least one battery 12 is placed in a battery holder 13) and a removable DC light source 14 in the circuit 11. The light source (either a bulb or a LED or other DC activated light source 14) is adjacent the keyhole 105 and the light source 14 protrudes through (it may also not protrude through the wall and may rest even with or just below the wall) a second port 15 in the wall 107 of the knob 102 to illuminate the keyhole so that a key 108 may be more easily inserted therein. There is a switch 16 in the illumination circuit 11. The switch 16 has a stationary contact 17 attached to a insulation member 21 and a sliding contact rod 18, connected to and actuated by the knob 102, is springingly biased (see spring 19) away from the stationary contact 17. As the knob is pushed in toward the door 100, the knob pushes the sliding contact rod 18 toward and in releasable contact with the stationary contact 17 thereby closing the circuit 11 and causing the light 14 to illuminate the keyhole 105. There is a light diffusing directional (the lens may be shaped to direct the light and may be frosted or opaque) lens 20, releasably connected to the wall 107 of the knob 102, over the light source 14 to protect the light source and to assist in placing light upon the keyhole 105.

The foregoing descriptions and drawings of the invention are explanatory and illustrative only, and various changes in shape, sizes and arrangements of parts as well certain details of the illustrated construction may be made within the scope of the appended claims without departing from the true spirit of the invention.

I claim:

1. An illuminated locking doorknob apparatus for a door, comprising:
- a door locking set which further comprises:
  - a knob and lock retaining mechanism, passing through the door;
  - a lock core removingly and rotationally secured within the knob and retaining mechanism; and
  - a keyhole located within the lock core, which is accessible through a first port in a wall of the knob;
- an illumination circuit contained within the door locking set which further comprises:
  - a power source in the circuit;
  - a light source, disposed adjacent the keyhole and protruding through a second port in the wall of the knob; and
  - a switch in the circuit, the switch further comprising:
    - a first contact which is attached to a stationary insulation member; and
    - a second contact which is slidingly engagable with the first contact, the second contact being attached to the knob such that the first and second contacts are mated whenever inward pressure is applied to the knob, pushing the knob toward the door;
    - said first and second contacts becoming disengaged whenever the inward pressure is released from the knob; and
- a lens, connected to the wall of the knob, over the light source.

2. An illuminated locking doorknob apparatus for a door, comprising:
- a door locking set which further comprises:
  - a knob and lock retaining mechanism, passing through the door;
  - a lock core removingly and rotationally secured within the knob and retaining mechanism; and
  - a keyhole located within the lock core, which is accessible through a first port in a wall of the knob;
- an illumination circuit contained within the door locking set which further comprises:
  - a removable power source in the circuit;
  - a removable light source, disposed adjacent the keyhole and protruding through a second port in the wall of the knob; and
  - a switch in the circuit, the switch further comprising:
    - a first contact which is attached to a stationary insulation member; and
    - a second contact which is slidingly engagable with the first contact, the second contact being attached to the knob such that the first and second contacts are mated whenever inward pressure is applied to the knob, pushing the knob toward the door;
    - said first and second contacts becoming disengaged whenever the inward pressure is released from the knob; and
- a light diffusing directional lens, releasably connected to the wall of the knob, over the light source.

3. An illuminated locking doorknob apparatus for a door, comprising:
- a door locking set which further comprises:
  - a knob and lock retaining mechanism, passing through the door;
  - a lock core removingly and rotationally secured within the knob and retaining mechanism; and
  - a keyhole located within the lock core, which is accessible through a first port in a wall of the knob;
- an illumination circuit contained within the door locking set which further comprises:
  - a removable DC power source in the circuit;
  - a removable DC light source, disposed adjacent the keyhole and protruding through a second port in the wall of the knob; and
  - a switch in the circuit, the switch further comprising:
    - a first contact which is attached to a stationary insulation member; and
    - a second contact which is slidingly engagable with the first contact, the second contact being attached to the knob such that the first and second contacts are mated whenever inward pressure is applied to the knob, pushing the knob toward the door;

said first and second contacts becoming disengaged whenever the inward pressure is released from the knob; and a light diffusing directional lens, releasably connected to the wall of the knob, over the light source.

* * * * *